United States Patent [19]

Inoue

[11] Patent Number: 4,604,818

[45] Date of Patent: Aug. 12, 1986

[54] UNDER REAMING PILE BORE EXCAVATING BUCKET AND METHOD OF ITS EXCAVATION

[75] Inventor: Hachiro Inoue, Ichikawa, Japan

[73] Assignee: Kabushiki Kaisha Tokyo Seisakusho, Urayasu, Japan

[21] Appl. No.: 758,329

[22] Filed: Jul. 24, 1985

[30] Foreign Application Priority Data

Aug. 6, 1984 [JP] Japan ..... 59-164393
May 31, 1985 [JP] Japan ..... 60-118191
Jun. 1, 1985 [JP] Japan ..... 60-83076[U]

[51] Int. Cl.[4] ..... E02E 1/00; E01H 13/04

[52] U.S. Cl. ..... 37/195; 175/5; 175/265; 175/285; 175/57

[58] Field of Search ..... 37/195, 183 R–188; 175/5–6, 10, 24, 40, 45, 53, 57, 58, 263, 265, 273, 292, 307, 284–285, 238, 242

[56] References Cited

U.S. PATENT DOCUMENTS 2,499,508 3/1950 Karhu ..... 175/285
2,758,398 8/1956 Bott ..... 37/187
2,910,274 10/1959 Scott ..... 175/285
3,434,551 3/1969 Rosfelder ..... 175/6
3,508,622 4/1970 Benetti et al. ..... 175/292
3,621,923 11/1971 Allard ..... 37/183 R
3,684,040 8/1972 Heacox ..... 175/285 X
3,965,999 6/1976 Mathieu et al. ..... 37/187
4,323,129 4/1982 Cordes ..... 175/285
4,436,167 3/1984 Masuda et al. ..... 175/285
4,488,606 12/1984 Inoue ..... 175/265

*Primary Examiner*—E. H. Eickholt
*Attorney, Agent, or Firm*—Bachman & LaPointe

[57] ABSTRACT

An under reaming pile bore excavating bucket by which an under reamed part of a pile bore is excavated and the excavated soil is moved into the bucket for easy removal of the soil. In use, the bucket is lowered to the bottom of an already excavated straight pile bore; side apertures of the bucket are opened; the slidable wing drill bits are rotated and moved downward and outward along guide rails to excavate an under reamed part. The excavated soil is taken into the bucket through the side apertures and openable bottom apertures. When the drill bits reach their lowermost position, the drill bits are rotated reversely to house the drill bits again into the bucket and lastly the side apertures are closed. The soil within the bucket is raised from the excavated pile bore. In particular, a drive shaft is spline engaged with an outer pipe fixed to the center of the bucket body for allowing the slidable bits to rotate and further move downward or outward.

16 Claims, 24 Drawing Figures

UNDER REAMING PILE BORE EXCAVATING BUCKET AND METHOD OF ITS EXCAVATION

BACKGROUND OF THE INVENTION

1. Field of the Invention

The present invention relates generally to an under reaming pile bore excavating bucket and the method of excavating an under reamed part of a pile bore, and more particularly to an excavating bucket such that an under reamed part of a pile bore can be excavated and further the excavated soil can be moved into the bucket body for easy removal of soil. The bucket includes, in particular, a plurality of slidable wing bits housed within a bucket and moved downward and extended outward along guide rails at the bottom of an already excavated straight pile bore.

2. Description of the Prior Art

In executing pile foundations in construction works, a method of drilling earth (earth drill method) is conventionally adopted. In this earth drill method, a rotatable bucket is used for excavating a straight pile bore and moving the excavated soil from the excavated bore to the outside. The bucket is attached to the lowermost position of a kelly rotatably suspended by a crane. The bucket includes a bottom plate provided with a plurality of drill bits. When the bucket is rotated by the kelly, the soil excavated by the drill bits are taken into the bucket. The bucket filled with the excavated soil is raised by the crane and the soil in the bucket is removed by opening the bottom plate thereof.

By the way, as an economical method of executing pile foundations, an under reamed bore foundation is well known, in which a larger diameter bore is excavated at the bottom of a straight pile bore to increase the pile end bearing capability against a vertical load applied to the pile.

In the earth drill method using a bucket, however, it is rather difficult to realize an under reaming pile bore excavating bucket of simple configuration and a method of executing the same in simple steps.

A more detailed description of the prior-art pile bore excavating bucket will be made hereinafter with reference to the attached drawings under DETAILED DESCRIPTION OF THE INVENTION.

SUMMARY OF THE INVENTION

With these problems in mind therefore, it is the primary object of the present invention to provide an under reaming pile bore excavating bucket of simple configuration and a method of excavating an under reamed part of a pile bore in simple steps by the use of a bucket.

To achieve the above-mentioned object, the under reaming pile bore excavating bucket according to the present invention comprises: (a) a bucket body formed with side apertures near the lower part thereof; (b) a bucket bottom plate attached to the bottom thereof so as to open or close the bottom and formed with openable bottom apertures for taking excavated soil into the bucket body; (c) an outer pipe fixed to the bucket body at the center of the bucket body; (d) a drive shaft telescopically engaged with the outer pipe for rotating the bucket body when an excavating torque is applied, the drive shaft sliding downward when rotated in one direction and upward when rotated in the other direction; (e) a bucket cover engaged with the drive shaft and assembled with the bucket body so as to open the side apertures of the bucket body when rotated in one direction and close the side apertures when rotated in the other direction by the drive shaft; (f) a plurality of guide rails fixed to said outer pipe at an inclined angle with respect to the axis of the outer pipe; (g) a plurality of connecting rod, each of one ends of the rods being pivotably connected to the drive shaft, respectively; and (h) a plurality of slidable wing bits pivotably connected to each of the other ends of the connecting rods, respectively and slidably mounted on the guide rails at an appropriate bit angle to excavate an under reamed part of a pile bore.

In the excavating bucket thus constructed, when the drive shaft is driven in one direction, the side apertures of the bucket body are first opened and then the wing drill bits are rotated in the same direction together with the bucket body and further moved downward and outward along the guide rails passing through the side apertures now opened by a force of gravity applied thereto to excavate an under reamed part of a pile bore; the excavated soil is taken into the bucket body through the opened side apertures and the openable bottom apertures; and when the drive shaft is driven in the other direction, the wing drill bits are moved upward and inward through the side apertures along the guide rails by a torque applied to the drive shaft and lastly the side apertures of the bucket are closed to raise the bucket filled with soil.

Further, to achieve the above-mentioned object, the method of excavating an under reamed part of a pile bore according to the present invention comprises the following steps of: (a) excavating a straight pile bore; (b) lowering an excavating bucket to the bottom of the straight pile bore; (c) closing a bucket bottom plate when the bucket reaches the bottom of the straight pile bore; (d) rotating a drive shaft in the forward direction to first open side apertures of the bucket and then to drive wing drill bits together with the bucket body in such a way that rotated wing drill bits move downward and extend outward along guide rails passing through the opened side apertures to excavate the under reamed part of the pile bore, while taking excavated soil into the bucket body through the side apertures of the bucket body and the openable bottom apertures of the bucket bottom plate; (e) if the wing drill bits reach their lowermost position, rotating the drive shaft in the reverse direction to move the wing drill bits upward and contract them inward along the guide rails passing through the opened side apertures to house again the drill bits within the bucket body while moving excavated soil to under the bucket and taking the moved soil into the bucket through the openable bottom apertures; (f) closing the side apertures by the bucket cover; (g) raising the excavating bucket onto the ground; and (h) opening the openable bucket bottom plate to remove the excavated soil within the bucket body to the outside.

BRIEF DESCRIPTION OF THE DRAWINGS

The features and advantages of the under-reaming pile bore excavating bucket according to the present invention will be more clearly appreciated from the following description taken in conjunction with the accompanying drawings in which like reference numerals designate the same or similar elements or sections throughout the figures thereof and in which.

DETAILED DESCRIPTION OF THE PREFERRED EMBODIMENTS

To facilitate understanding of the present invention, a brief reference will be made to a prior-art method of excavating a pile bore in construction works for executing pile foundations, that is, so-called earth drill method.

Figure 1:
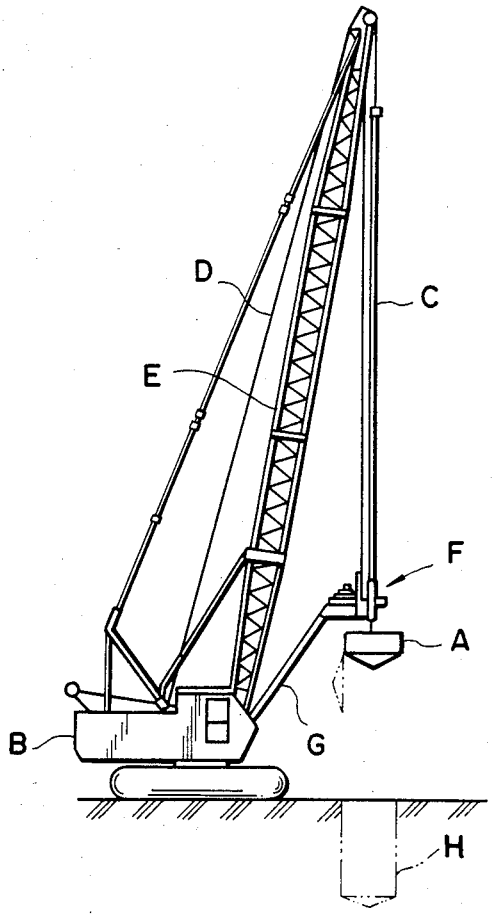
FIG. 1 is a general view showing a crane which drives a pile bore excavating bucket, for assistance in explaining earth drill method adopted for construction works.

In FIG. 1, an excavating bucket A is supported by a crane B. The bucket A is attached to the lowermost end of a kelly C. This kelly C is connected to a rope D supported by a boom E of the crane B. Further, the kelly C is rotated by a driving unit F supported by the crane B through an arm G. The bucket A is provided with a plurality of excavating bits arranged at the conical bottom plate thereof. The excavated soil under the bucket is taken into the rotating bucket through openable bottom apertures formed in the bottom plate during excavation. The bottom plate is opened or closed by means of an appropriate hooking mechanism for removal of excavated soil within the bucket.

In operation, when the bucket A is rotated by the kelly C, a rotational force and a thrust are applied from the kelly C to the bucket A simultaneously, so that the drill bits excavate a straight pile bore H and the excavated soil is moved into the bucket through appropriate openable apertures formed in the bottom plate. When the bucket A is filled with excavated soil, the bucket A is raised and moved by the crane B onto a bed of a dump truck, the excavated soil being dropped onto the dump truck bed by opening the bottom plate of the bucket A.

By the way, to increase the pile end bearing capability against a vertical load applied to the pile, it is preferable to use an under reamed pile bore foundation, in which a larger diameter bore is excavated at the bottom of a straight pile bore.

In the conventional excavating bucket A as described above, it is impossible to excavate an under reamed pile bore.

Figure 2A:
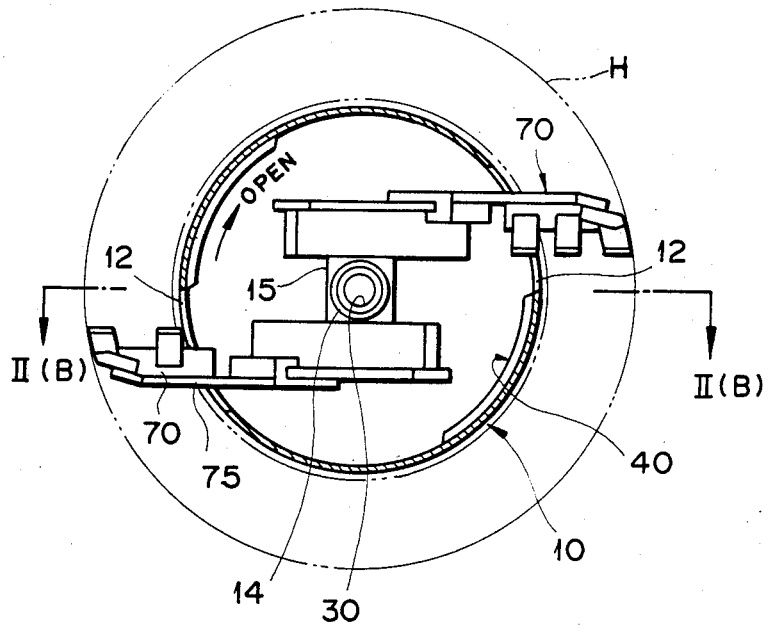
FIG. 2(A) is a lateral cross sectional view, partly in top view, of a first embodiment of the under reaming pile bore excavating bucket according to the present invention, in which two wing drill bits are extended outward from a bucket.
Figure 2B:
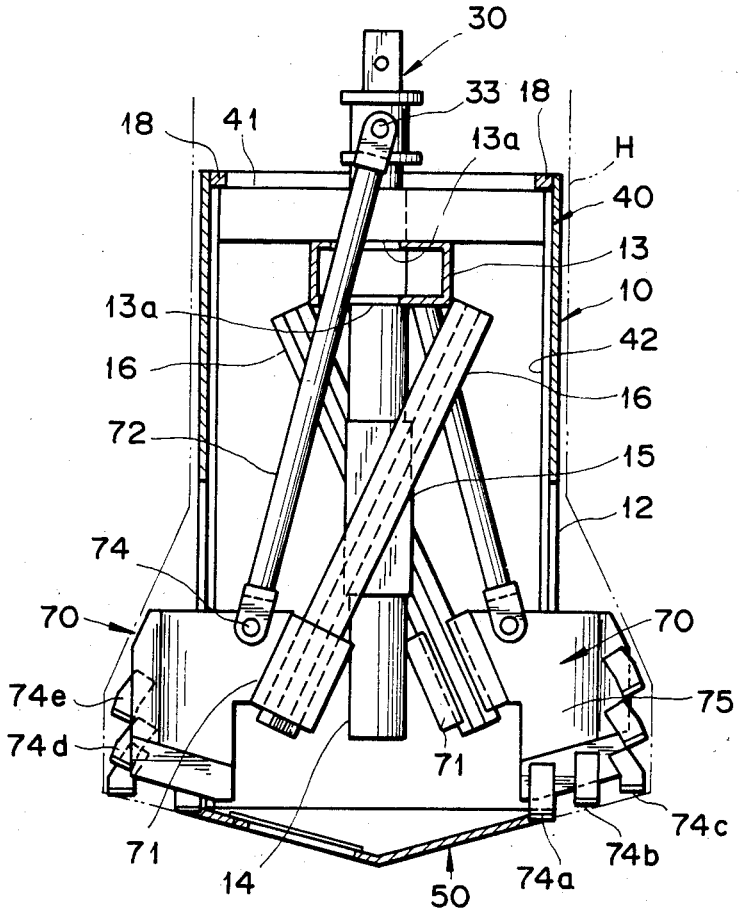
FIG. 2(B) is a longitudinal cross sectional view, partly in side view, of the first embodiment of the pile bore excavating bucket according to the present invention, taken along the line II(B)—II(B) shown in FIG. 2(A), in which two wing drill bits are extended outward from the bucket.
Figure 3A:
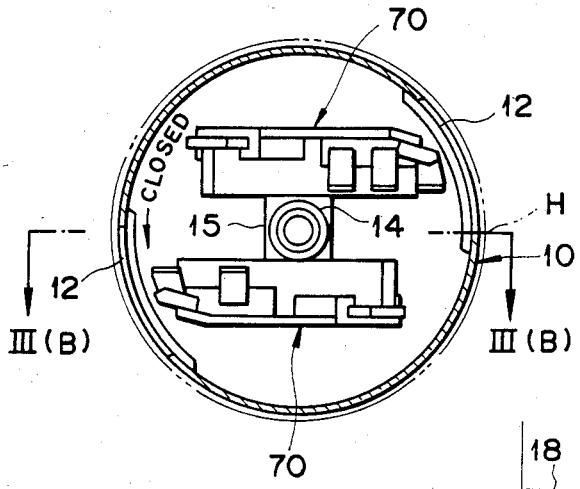
FIG. 3(A) is a lateral cross sectional view, partly in top view, of the first embodiment of the pile bore excavating bucket according to the present invention, in which the two wing drill bits are housed within the bucket.
Figure 3B:
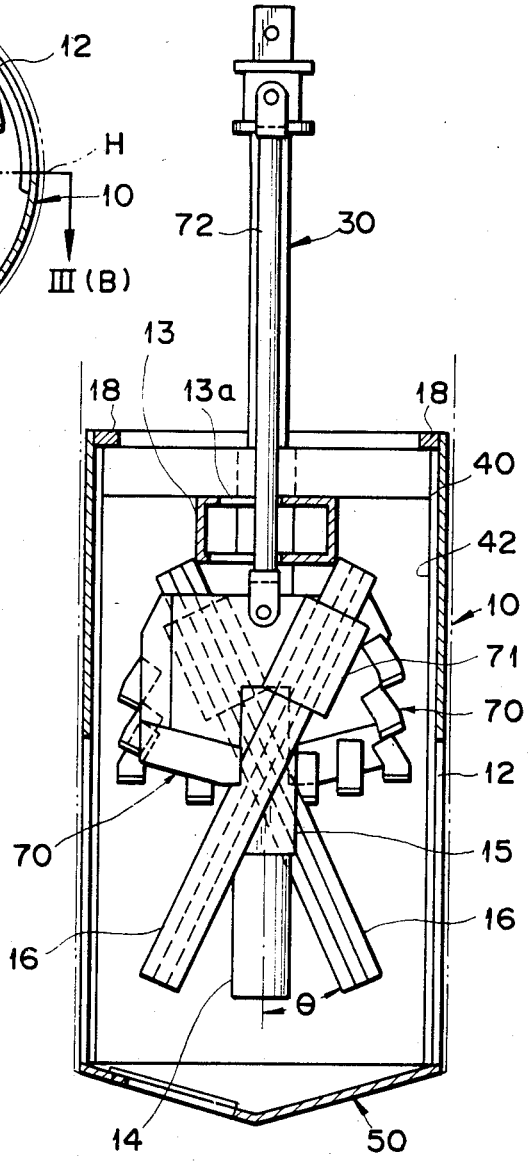
FIG. 3(B) is a longitudinal cross sectional view, partly in side view, of the first embodiment of the pile bore excavating bucket according to the present invention, taken along the line III(B)—III(B) shown in FIG. 3(A), in which the two wing drill bits are housed within the bucket.

In view of the above description, reference is now made to a first embodiment of an under reaming pile bore excavating bucket according to the present invention with reference to the attached drawings. FIGS. 2(A) and 2(B) show a state where a plurality of wing drill bits are entended outward to excavate an under reamed part of a pile bore; FIGS. 3(A) and 3(B) show a state where a plurality of wing bits are retracted inward within the bucket; FIGS. 4(A), 4(B), 4(C) and 4(D) show essential elements of the excavating bucket according to the present invention.

The excavating bucket is roughly made up of a cylindrical bucket body 10, a splined drive shaft 30, a pivotable bucket cover 40, a conical bucket bottom plate 50, and two slidable wing drill bits 70.

Figure 4A:
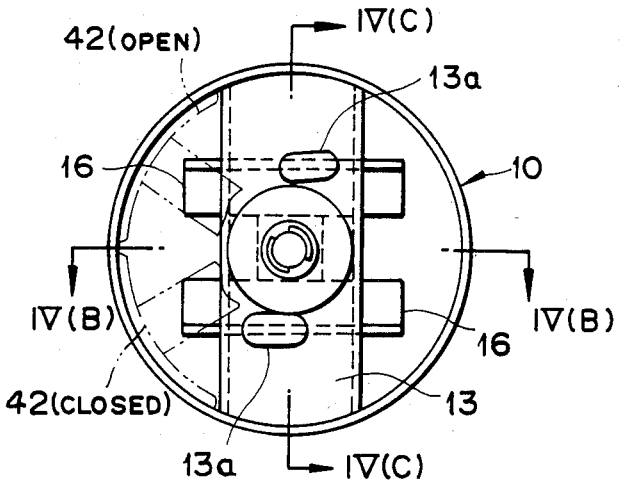
FIG. 4(A) is a top view showing a bucket body adopted for the first embodiment of the excavating bucket according to the present invention.
Figure 4B:
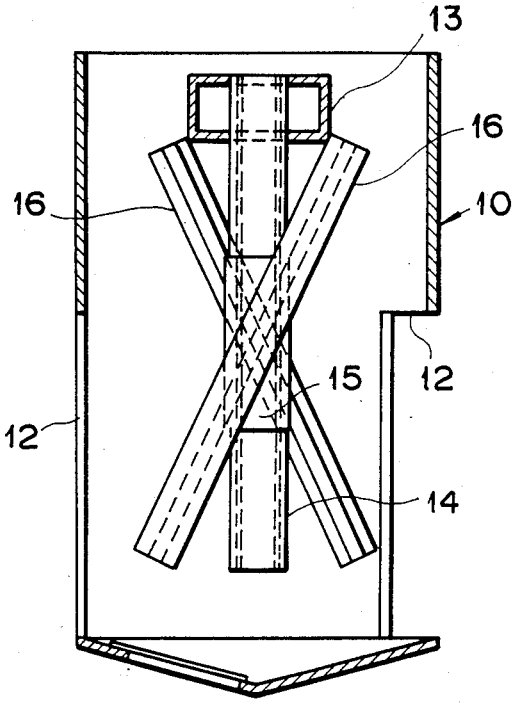
FIG. 4(B) is a first longitudinal cross sectional view, partly in side view, showing the bucket body adopted for the first embodiment of the excavating bucket according to the present invention, taken along the line IV(B)—IV(B) shown in FIG. 4(A)

The cylindrical bucket body 10 is formed with two side apertures 12 of rectangular shape, as best shown in FIG. 4(B), in the cylindrical surface thereof in diametrically opposed positional relationship with respect to the center of the bucket body 10. Through the two opened side apertures 12, the two slidable wing drill bits 60 are extended outward, as described in more detail later.

Figure 5A:
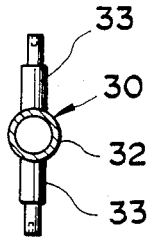
FIG. 5(A) is a top view showing a splined drive shaft adopted for the first embodiment of the excavating bucket according to the present invention.
Figure 5B:
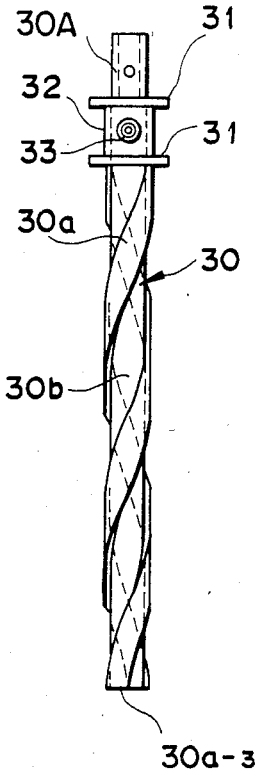
FIG. 5(B) is a side view showing the splined drive shaft having a plurality of outer helical spline tongues adopted for the first embodiment of the excavating bucket according to the present invention.

Near the uppermost postion of the cylindrical bucket body 10, a wing bit supporting member 13 of rectangular cross section is fixed by welding to the inner circumferential surface of the bucket body 10 extending radially within the body 10, as best shown in FIG. 4(A). In this supporting member 13, a central hole and a pair of slots 13*a* are formed, also as best shown in FIG. 4(A). In the central hole of the supporting member 13, an outer pipe 14 having helical spline tongues 14*a* and grooves 14*b*, as shown in FIG. 5(D), is fixed by welding to the supporting member 13 extending axially into the bucket body 10.

At the outer middle portion of the outer pipe 14 within the cylindrical bucket body 10, a square pipe 15 is fixed by welding. On both the outer surfaces of the square pipe 15, two guide rails 16 of T-shaped cross section are fixed respectively by welding extending downward and outward at an appropriate skew angle $\theta$ with respect to the outer pipe 14 so as to cross the axis of the cylindrical bucket body 10 in x-shaped fashion, as shown in FIG. 3(B). Along these two guide rails, the two slidable wing drill bits 70 (described later) are moved up and down or extended downward or retracted upward.

Into the above-mentioned outer pipe 14, the splined drive shaft 30 is telescopically engaged rotatably and slidably in the axial direction thereof. As depicted in FIG. 5(B), the splined drive shaft 19 is formed with two flanges 31, being spaced from each other. Between these two flanges 31, an annular bushing 32 is rotatably disposed. On the outer surface of the annular bushing 32, two connecting rod pins 33 are fixed by welding or implanted in the diametrically opposite direction, as best seen in FIG. 5(A). The splined drive shaft 30 has two helical outer tongues 30*a* and two helical outer grooves 30*b*. Further, the top 30*a* of the drive shaft 30 is connected to the kelly C.

Figure 6A:
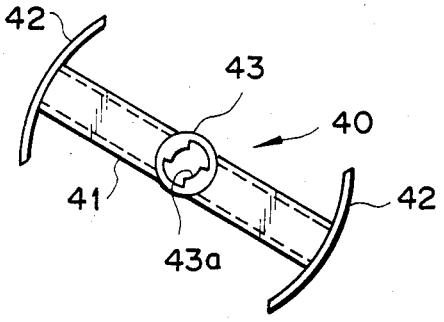
FIG. 6(A) is a top view showing a bucket cover adopted for the first embodiment of the excavating bucket according to the present invention.
Figure 6B:
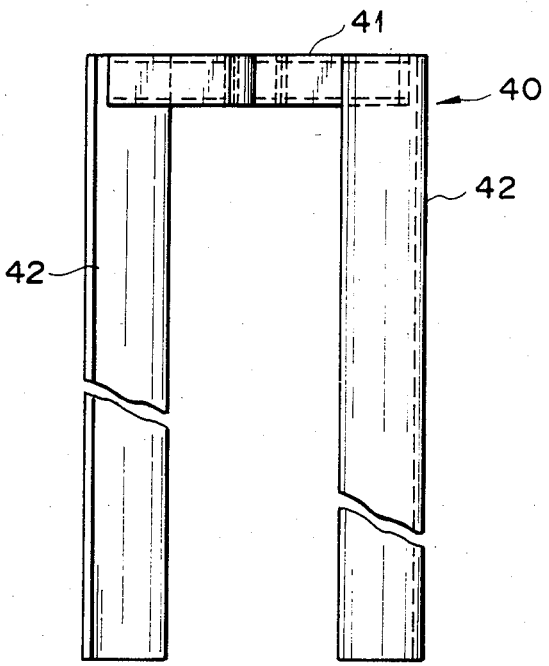
FIG. 6(B) is a side view showing the bucket cover adopted for the first embodiment of the excavating bucket according to the present invention.

The pivotable bucket cover 40 is made up of a cover supporting frame 41 and a pair of cylindrical arc shaped members 42 connected by the support frame 41 at its uppermost position. Further, at the center of the support frame 41, a central bushing 43 having splines 43*a* is provided so that the spline drive shaft 30 can be engaged therewith, as best shown in FIG. 6(A). The above pivotable bucket cover 40 is inserted into the inner circumference of the bucket body from above and the cover supporting frame 41 is placed onto the drill bit supporting member 13 as shown in FIGS. 2(B) and 3(B). Further, after having been placed onto the bit supporting member 13, the cover supporting frame 41 is held by a pair of circular arc members 18 attached by bolts and nuts to the inner circumferential surface of the backet body 10 at its top end, as shown in FIGS. 2(B) and 3(B), to prevent the assembled bucket cover 40 from being removed from the bucket body 10. The bucket cover 40 opens the two side apertures 12 of the bucket body 10 when pivoted in one direction (clockwise) but closes the two side apertures 12 when pivoted in the other direction (counterclockwise). In other words, the cylindrical arc width of the member 42 roughly corresponds to that of the side aperture 12 of the bucket body 10.

Figure 4C:
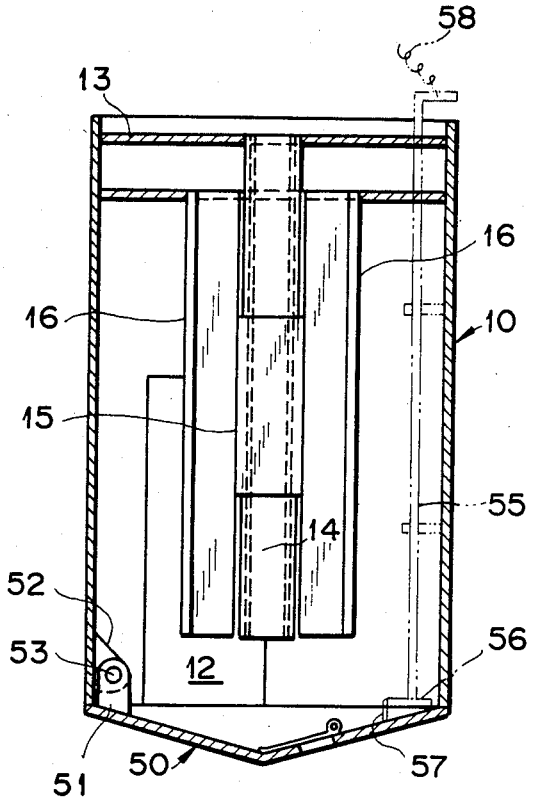
FIG. 4(C) is a second longitudinal cross sectional view, partly in side view, showing the bucket body adopted for the first embodiment of the excavating bucket according to the present invention, taken along the line IV(C)—IV(C) shown in FIG. 4(A)
Figure 4D:
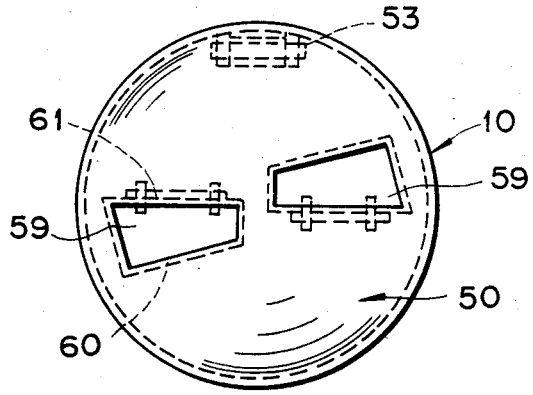
FIG. 4(D) is a bottom view showing a bucket bottom plate adopted for the first embodiment of the excavating bucket according to the present invention.

The conical bucket bottom plate 50 is attached to the bottom of the bucket body 10 so as to be opened or closed, as best shown in FIG. 4(D). The bottom plate 50 is supported by a hinge 53 at one hand and by a hook mechanism at the other hand. In more detail, a first hinge plate 51 shown in FIG. 4(C) is fixed by welding to the periphery of the bottom plate 50. A second hinge plate 52 is fixed by welding to the inner circumference of the bucket body 10 near its lowermost position. A hinge pin 53 is inserted through the first and second hinge plates 51 and 52. Therefore, the bottom plate 50 can be opened or closed with this hinge pin 53 as its axis.

At the diametrically opposite position of the hinge pin 53, a hooking mechanism is provided. The hooking mechanism is made up of an operation rod 55 having an engaging plate member 56 at the lowermost position, an engaging pawl member 57 and a return spring 58, as depicted in FIG. 4(C). The operation rod 55 is pivotably suported near the inner circumference of the bucket body 10 so as to be operable from the outside and is urged in one direction by the elastic force of a return spring 58. The engaging pawl member 57 is fixed by welding to the bottom plate 50.

When the bucket body 10 is lowered into a pile bore and therefore the bottom plate 50 is brought into contact with the bottom of a pile bore, the bottom plate 50 begins to be closed gradually. In this connection, the bottom plate 50 can more easily be closed when the bucket body 10 is pivoted or rotated appropriately. When the bottom plate 50 is almost closed, the engaging pawl member 57 urges the engaging plate member 56 in one direction against the elastic force of the return spring 58 to an engagement position where the plate member 56 returns. At this position, pawl member 57 engages with the plate member 56 to lock the bottom plate 50 to the bucket body 10. Further, to open the bottom plate 50 for removal of soil, the operation rod 55 is pivoted against the force of the return spring 58 to disengage the plate member 56 from the pawl member 57, so that the bottom plate 50 can be opened downward by its weight.

Further, a pair of bottom apertures 59 are formed in the bottom plate 50 as best shown in FIG. 4(D). These apertures 59 are closed from the inside of the bucket body 10 by cover plates 60, respectively, supported by hinges 61. Since the cover plates 60 are placed inside the bucket body 10, usually these apertures 59 are closed; however, it is possible to open these apertures for moving soil or muck remaining at the bottom of a pile bore into the bucket body 10 when the bucket body 10 is rotated in the direction opposite to excavation.

The two slidable wing drill bits 70 having a plurality of bit teeth 74*a*, 74*b*, 74*c* are fixed by welding to two slidable blocks 71, respectively, which slidably engage with the T-shaped guide rails 16. Further, the wing drill bits 70 are connected to the spline drive shaft 30 by a connecting rod 72. One end of the connecting rod 72 is pivotably supported by the pin 33 attached to the annular bushing 32; the other end of the connecting rod 72 is also pivotably supported by a pin 74 attached to the wing drill bits 70, respectively. Further, since a pair of slots 13*a* are formed in the wing bit supporting member 13 and each of the upper end of the connecting rod 72 is inserted in the slot 13*a*, the connecting rod 72 is movable within the slot 13*a* when moved up and down or inward and outward by the splined drive shaft 30.

Further, since the guide rails 16 are arranged in X-shaped fashion within the bucket body 10 as shown in FIGS. 2(B) and 3(B), it is possible to effectively house the wing drill bits within the bucket body 10 and to extend them out of the bucket body 10.

In the first embodiment, a plurality of bottom bit teeth 74*a*, 74*b*, 74*c* are fixed by welding to a flat wing bit plate 75 to excavate the bottom of a pile bore, and a plurality of side bit teeth 74*d*, 74*e* are fixed also by welding to the flat wing bit plate 75 to excavate the under reamed part of a pile bore, as depicted in FIG. 2(B).

With reference to FIGS. 5(B), (C) and (D), the spline engagement between the splined drive shaft 30 and the outer pipe 14 will be described hereinbelow in further detail.

The splined drive shaft 30 is formed with two helical outer tongues 30*a* and two helical outer grooves 30*b*. The angular width of the outer tongues 30*a* is about 75 degrees around the shaft 30 and the angular width of the outer grooves 30*b* is about 105 degrees. Therefore, the angular ratio of tongue and groove is 75 to 105 or 5 to 7.

The outer pipe 14 is formed with two helical inner tongues 14*a* and the two helical inner grooves 14*b*. The angular width of the inner tongue 14*a* is about 60 degrees around the outer pipe 14 and the angular width of the inner groove 14*b* is about 120 degrees. Therefore, the angular ratio of tongue and groove is 60 to 120 or 1 to 2. Further, near the top of the outer pipe 14, there are formed two horizontal stepped cutout portions 14A, the angular width of which is about 45 degrees, as depicte in the opened-view of FIG. 5(C). Since the splined drive shaft 30 is engaged with the outer pipe 14 in spline engagement, when the splined drive shaft 30 is rotated clockwise by the kelly C (shown in FIG. 1), the outer pipe 14 (bucket body) is also rotated clockwise. Further, the drive shaft 30 is telescopically inserted into the outer pipe 14.

The splines are designed so as to have a common skew angle with respect to the axial direction of the drive shaft 30 or the outer pipe 14.

The skew angle $\gamma$ can be obtained readily by using the following simple expressions, so that a downward force will cancel the frictional force produced between the drive shaft 30 and the outer pipe 14, while transmitting a torque from the splined drive shaft 30 to the outer pipe 14:

$$R=\mu Q \text{ or } \mu=R/Q=\tan\gamma$$

Where Q is the normal component of the rotation force P, R is the tangential component, and $\mu$ is a coefficient of friction.

Further, if this skew angle is excessively large, the bucket body 10 may be moved upward while rotating; if excessively small, it is impossible to effectively slide the drive shaft 30 into the outer pipe 14 or the bucket body 10 without friction. Therefore, an appropriate angle (14 to 16 degrees) is required. In this connection, the splines are made of carbon steel or copper alloy. The drive shaft 30 is moved in the downward direction by the aid of the weight of kelly c or a thrust applied to the kelly.

Figure 5C:
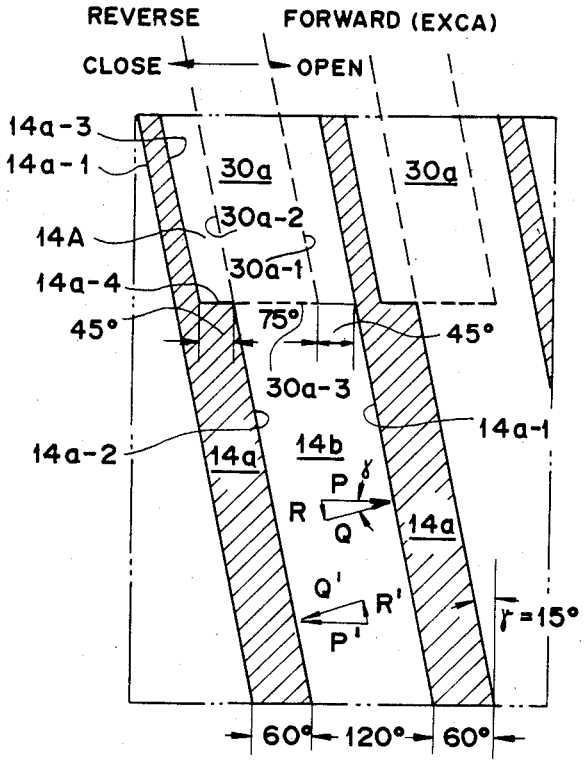
FIG. 5(C) is an opened-out view of an outer pipe having a plurality of helical spline tongues and grooves formed on the inner circumferential surface thereof (shown by solid lines) and a drive shaft having a plurality of helical spline tongue formed on the outer circumferential surface thereof (shown by dashed lines)
Figure 5D:
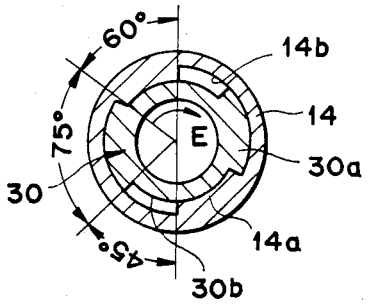
FIG. 5(D) is a lateral cross sectional view showing the spline engagement relationship between the outer helical tongues of the drive shaft and the inner helical tongues of the outer pipe.

Since the spline engagement is arranged as described above, when the splined drive shaft 30 is rotated in the forward direction (clockwise when seen from the top in FIGS. 2(B), 3(B), or 5(B)) to excavate an under reamed part of a pile bore, the outer helical tongues 30*a* engage with the inner helical grooves 14*b*, as best shown in the opened-out view of FIG. 5(C), to rotate the outer pipe 14 also in the forward direction and further to drive the drive shaft 30 in the downward direction.

In more detail, in the forward direction, the sloped side surfaces 30*a*-1 of the outer tongues 30*a* of the drive shaft 30 are brought into contact with the sloped side surfaces 14*a*-1 of the inner tongues 14*a*. Therefore, the rotation force P is divided into the normal component Q to rotate the outer pipe 14 clockwise and the tangential component R to move the drive shaft 30 itself smoothly downward. Since the outer pipe 14 is fixed to the bucket body 10, the wing drill bits 70 rotate clockwise to excavate soil. When the tangential component R is roughly equal to the friction between the two, since the drive shaft 30 is connected to the wing drill bits 70 via the connecting rod 72, the wing bits 70 move smoothly downward and outward along the guide rail 16 to widen the diameter of the under reamed part of a pile bore.

On the other hand, when the splined drive shaft 30 is rotated in the reverse direction (counterclockwise) when seen from the top in FIGS. 2(B), 3(B), or 5(B)) to raise the wing drill bits 70, the outer helical tongues 30*a* engage with the inner helical grooves 14*b*, as best shown in the opened-out view of FIG. 5(C), to rotate the outer pipe 14 also in the reverse direction and further drive the drive shaft 30 in the upward direction.

In more detail, in the reverse direction, the sloped side surfaces 30*a*-2 of the outer tongues 30*a* of the drive shaft 30 are brought into contact with the sloped side surfaces 14*a*-2 of the inner tongues 14*a*. Therefore, the rotation force P′ is divided into the normal component Q′ to rotate the outer pipe 14 counterclockwise and the tangential component R′ to move the drive shaft 30 itself smoothly upward. Since the outer pipe 14 is fixed to the bucket body 10, the wing drill bits 70 rotate counterclockwise without excavating soil. Since the drive shaft 30 is connected to the wing drill bits 70 via the connecting rod 72, the wing bits 70 moves smoothly upward and inward along the guide rail 16 into the bucket body 10.

Further, the outer tongues 30*a* of the drive shaft 30 reach near the top position, the lower end surfaces 30*a*-3 of the outer tongues 30*a* of the drive shaft 30 are engaged with stepped cutout portions 14*a*-4 of the inner tongues 14*a* of the outer pipe 14 to close the side apertures 12. Thereafter, sloped side surfaces 30*a*-2 of the outer tongues 30*a* are brought into contact with the sloped side surfaces 14*a*-3 of the inner tongues 14*a*. However, when the sloped side surfaces 30*a*-2 are brought into contact with the sloped side surfaces 14*a*-3, the slidable drill wing bits 70 are stopped by appropriate stop members (not shown) fixed in position to the wing bit supporting member 13 of rectangular cross section.

Further, the side apertures 12 of the bucket body 10 are closed when the outer tongues 30*a* of the drive shaft 30 engages with the horizontal stepped cutout portions 14*a*-4 of the inner tongues 14*a* of the outer pipe 14. In more accuracy, since the angular width of the side apertures 12 is about 45 degrees, the apertures 12 begin to be closed when the outer tongues 30*a* reach the edge of the cutout portion 14*a*-4 or the edge surfaces 14*a*-2 of the inner tongues 14*a* at the uppermost position.

The operation of opening and closing the bucket cover 40 will be described hereinbelow. Since two inner tongues 43*a* are formed in the inner circumferential surface of the central bushing 43 of the cover supporting frame 41, as best shown in FIG. 6(A), and are engageable with the outer grooves 30*b* of the drive shaft 30, when the drive shaft 30 rotates, the bucket cover 40 is also rotated together therewith. Further, the bucket cover 40 is placed on the supporting frame 13 and is held by two circular arc members 18 attached to the uppermost position of the bucket body 10 as shown in FIG. 2(B) or 3(B). Therefore, even if rotated, the bucket cover 40 is neither raised or lowered, but rotated in either direction by a predetermined angle together with the drive shaft 30.

Here, it should be noted that since the two cylindrical arc shaped members 42 of the bucket cover 40 are inserted from top of the bucket body 10 into the two arched spaces surrounded by the inner circumference of the bucket body 10 and the straight end surface of the wing bit supporting member 13, the bucket cover is rotatable only within the above arched spaces as shown by dot-dot dashed lines in FIG. 4(A). Further, the angular width of the side apertures 12 of the bucket body 10 is approximately 45 degrees as shown in FIG. 2(A) or 2(B).

With reference to FIG. 5(C) again, when the outer tongues 30*a* of the drive shaft 30 are engaged with the inner tongues 14*a* of the outer pipe 14 as shown by the dashed line in FIG. 5(C), the bucket cover 40 begins to close the side apertures 12 of the bucket body 10. However, when the drive shaft 30 is rotated in the forward direction (clockwise in FIG. 4A) to excavate a pile bore, the side apertures 12 are first opened and then the sloped edge surfaces 30*a*-1 of the outer tongues 30*a* of the drive shaft 30 are brought into contact with the sloped edge surfaces 14*a*-1 of the inner tongues 14*a* of the outer pipe 14 to transmit a rotational power from the drive shaft 30 to the outer pipe 14, that is, to the bucket body 10. Further, the difference (45 degrees) in angular width between the outer tongues 30*a* (75 degrees) and the inner grooves 14*b* (120 degrees) is an idle angular space for driving the outer pipe 14 by the drive shaft 14.

The method and operation of excavating an under reamed pile bore by the use of the excavating bucket according to the present invention will be described hereinbelow.

With reference to FIG. 1, a straight pile bore H is first excavated to a predetermined depth by use of an ordinary bucket excavator provided with a plurality of fixed drill bits at the bottom thereof. In this case, the ordinary bucket excavator is suspended by a kelly C moved up and down by a crane, and rotated by a driving unit F supported by an arm G attached to the crane B. If the straight pile bore H is excavated to a predetermined depth, the ordinary bucket excavator is raised to the outside and exchanged with the excavating bucket according to the present invention. At this time, the splined drive shaft 30 is raised to its uppermost position and therefore the bucket cover 40 is closed, the two wing drill bits 70 being housed within the bucket body 10, as shown in FIGS. 3(A) and 3(B). The top 30A of the splined drive shaft 30 is connected to the lower end of the kelly C. The excavating bucket is lowered by the crane to the bottom of the straight pile bore. At this time, even if the conical bucket bottom plate 50 is opened, when the bucket is lowered, the bottom plate 50 is closed automatically, owing to the hooking mechanism 56 and 57 provided at the bottom of the bucket body 10.

When the splined drive shaft 30 is rotated clockwise (in the forward direction) in FIG. 3(A), the bottom end surfaces 30*a*-3 of the outer tongues 30*a* of the drive shaft 30 slide on the horizontal stepped cutout portion 14*a*-4 of the inner tongues 14*a* of the outer pipe 14 to open the side apertures 12 of the bucket body 10 and further the sloped side end surfaces 30*a*-1 of the drive shaft 30 are brought into contact with the sloped side end surfaces 14*a*-1 of the inner tongues 14*a* of the outer pipe 14, as depicted in FIG. 5(C). During this operation, the side apertures 12 closed by the bucket cover 40 are opened because the drive shaft 30 rotates the cover 40 simultaneously clockwise until the side edge of the cylindrical arc shaped member 42 is brought into contact with one end surface of the supporting frame 13 as shown in FIG. 4(A).

When the drive shaft 30 is further rotated, the drive shaft 30 rotates the outer pipe 14, that is, the bucket body 10, because a normal component Q is applied from the drive shaft 30 to the outer pipe 14 via the spline engagement. Simultaneously, the drive shaft 30 itself slides down into the outer pipe 14, because a tangential component R is generated beyond a friction force produced between the drive shaft 30 and the outer pipe 14. In other words, the splined drive shaft 30 moves telescopically into the outer pipe 14 while rotating the bucket body 10.

As the drive shaft 30 moves in the downward direction, the two slidable wing bits 70 extend gradually outwardly and downwardly along the guide rails 16 to excavate the under reamed part of the pile bore. The excavated soil is moved into the bucket body 10 directly through the side apertures 12 of the bucket body 10 or through the bottom apertures 59 of the conical bottom plate 50 by forcibly opening the cover plate 60 hinged against the bottom plate 50 from the inside. When the wing drill bits 70 slide up to its lowermost position, an under reamed part is completely excavated in addition to the straight pile bore.

After the excavation has been completed, the splined drive shaft 30 is rotated counterclockwise (in the reverse direction) to move the slidable wing drill bits 70 upward and inward. With reference to FIG. 5(C), the splined side end surfaces 30*a*-2 of the outer tongues 30*a* of the drive shaft 30 are brought into contact with the splined side end surfaces 14*a*-2 of the inner tongues 14*a* of the outer pipe 14. During this operation, the drive shaft 30 is rotated idle.

When the drive shaft 30 is further rotated counterclockwise and moved upward by the kelly, the drive shaft 30 is readily extracted from the outer pipe 14. Therefore, the two slidable wing bits 70 move gradually inwardly and upwardly along the guide rail 16 into the bucket body 10. At the end of this operation, the lower end surfaces 30*a*-3 of the outer tongues 30*a* of the drive shaft 30 are engaged with the horizontal stepped cutout portions 14*a*-4 of the inner tongues 14*a* of the outer pipe 14 and further the drive shaft 30 is rotated counterclockwise until the sloped side end surfaces 30*a*-2 of the outer tongues 30*a* are brought into contact with the sloped side end surfaces 14*a*-3 of the inner tongues 14*a* to close the side apertures 12 of the bucket body 10. The drive shaft 30 rotates the bucket cover 40 simultaneously counterclockwise until the side edge of the cylindrical are shaped members 42 are brought into contact with the supporting frame 13, as shown in FIG. 4(A).

Thereafter, the bucket body 10 including excavated soil is raised from the pile bore and then moved onto a dump truck. By operating the operation rod 55 shown in FIG. (C) in order to release the hook mechanism, the conical bottom plate 50 is opened, so that soil is discharged from the bucket body 10 onto a bed of the truck.

Figure 7A:
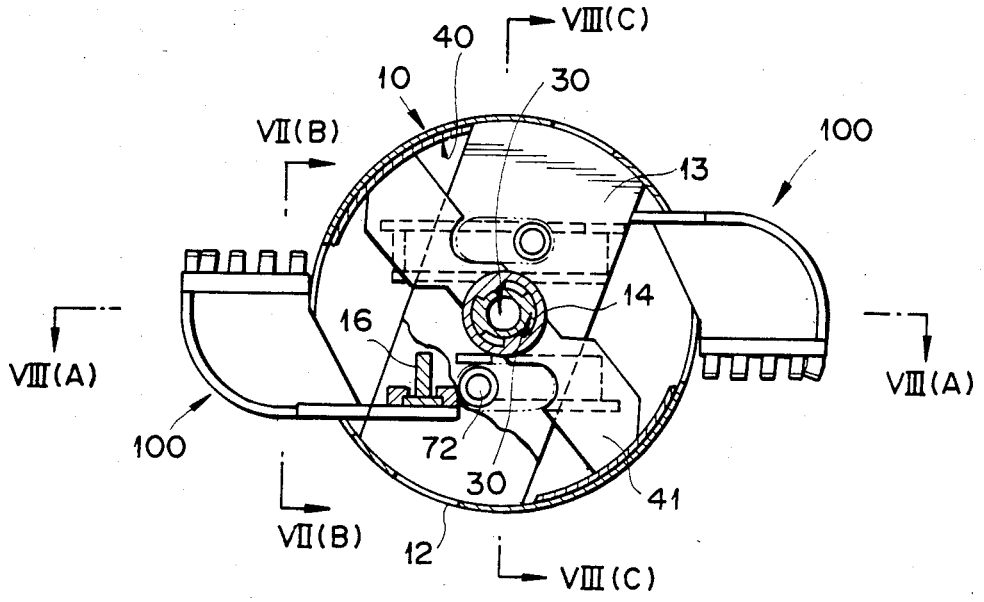
FIG. 7(A) is a lateral cross sectional view, partly in top view, of a second embodiment of the under reaming pile bore excavating bucket according to the present invention, in which the two wing drill bits are extended outward from a bucket.

With reference to FIGS. 7(A), (B), (C) and FIGS. 8(A), (B), (C), a second embodiment of an under reaming pile bore excavating bucket according to the present invention will be described hereinbelow. The features of the second embodiment is to provide two slidable wing drill bits of plough shape having a pivotable scraper respectively and further to form the bucket bottom plate with a fixed scraper for easily scraping and gathering the excavated soil.

Figure 8A:
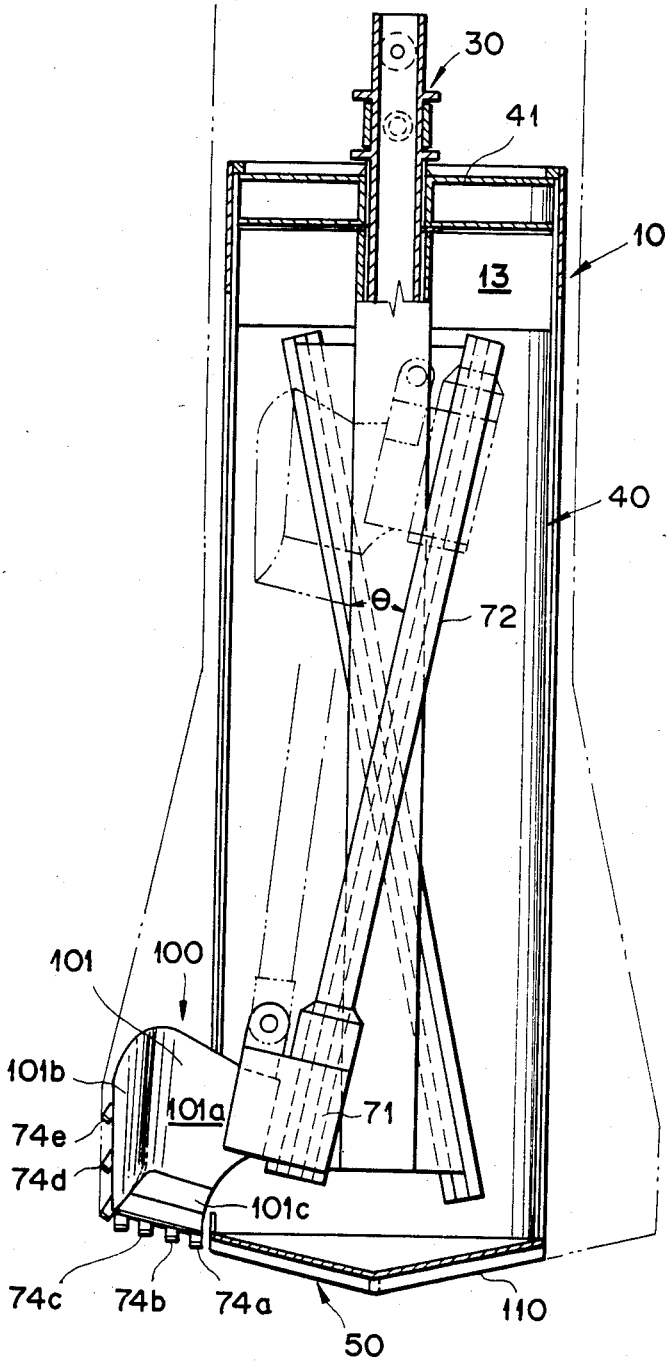
FIG. 8(A) is a longitudinal cross sectional view, partly in side view, of the second embodiment of the excavating bucket according to the present invention, taken along the line VIII(A)—VIII(8) shown in FIG. 7(A), in which the two wing drill bits are extended outward from the bucket body.

As best shown in FIG. 8(A), the slidable wing drill bit 100 includes a plough shaped bit plate 101 fixed to the slidable block 71 which slidably engages with the T-shaped guide rail 16. The bit plate 101 has a roughly flat back surface 101*a*, an arcuate outer side surface 101*b* and an arcuate bottom surface 101*c*. Therefore, while the bucket body 10 is lowered to excavate the under-reamed part of a pile bore, it is possible to effectively catch excavated soil and further to move it into the bucket body 10 through the opened apertures 12.

A plurality of bottom bit teeth 74*a*, 74*b*, 74*c*, 74*d* are fixed by welding to the arcuate bottom surface 101*c* to excavate the bottom of a pile bore. A plurality of side bit teeth 74*d*, 74*e* are fixed also by welding to the arcuate outer side surface 101*b* to excavate the under reamed part of a pile bore.

The lowermost edge of the bottom surface 101*c* is aligned on the extended line of the conical surface of the bucket bottom plate 50, when the slidable wing bit 100 is lowered to its lowermost position.

Figure 7B:
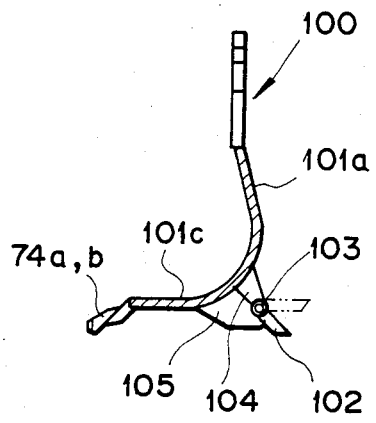
FIG. 7(B) is a cross sectional slide view, partly in side view, showing a pivotable scraper attached to the wing bits adopted for the second embodiment of the excavating bucket according to the present invention, taken along the line VII(B)—VII(B) shown in FIG. 7(A)
Figure 8B:
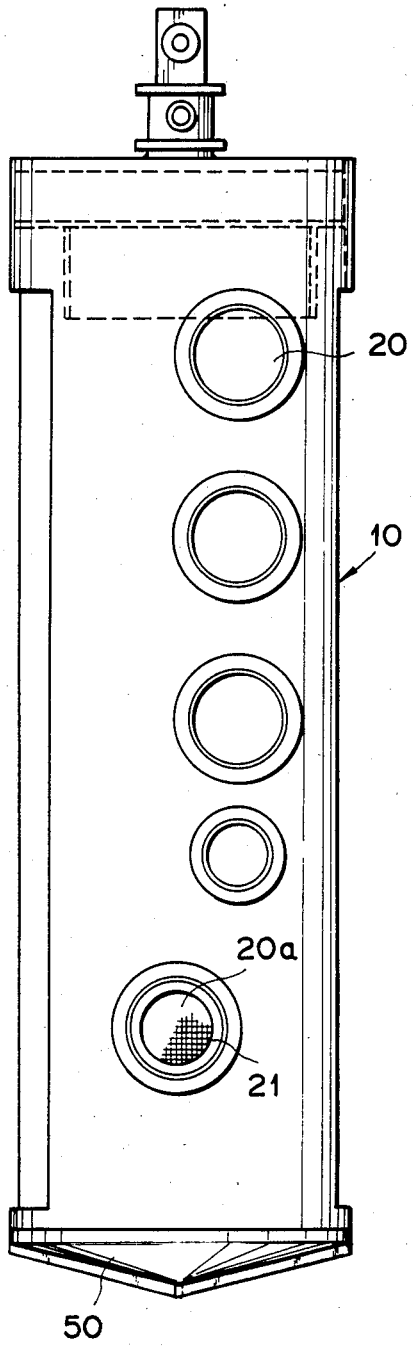
FIG. 8(B) is a side view of the second embodiment of the excavating bucket according to the present invention, in which the two wing drill bits are housed within the bucket body.
Figure 8C:
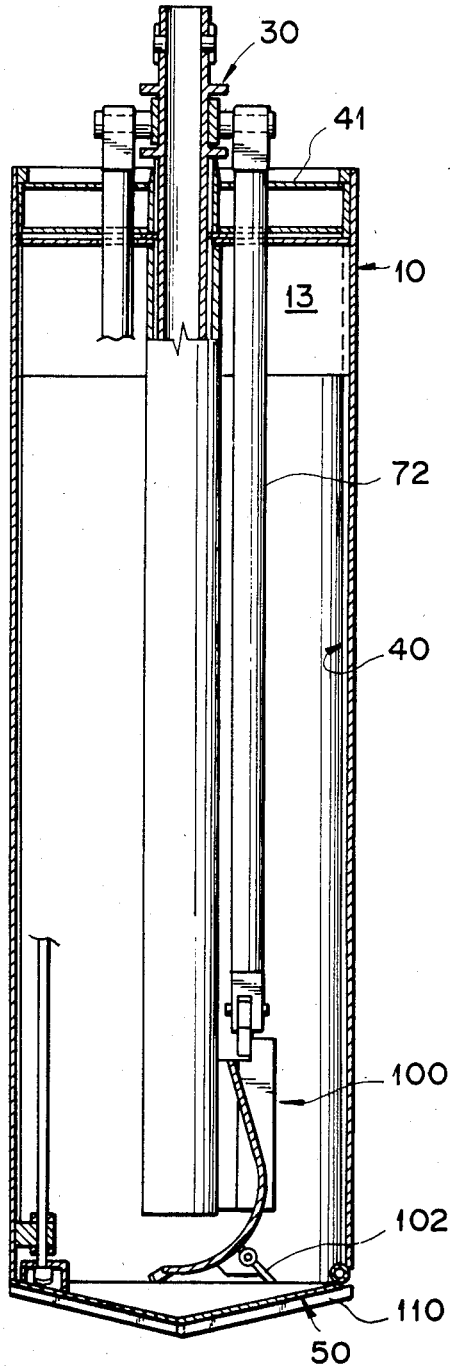
FIG. 8(C) is a longitudinal cross sectional view, partly in side view, of the second embodiment of the excavating bucket according to the present invention, take along the line VIII(C)—VIII(C) shown in FIG. 7(A), in which the two wing drill bits are extended outward from the bucket.

Although not shown clearly in FIG. 8(A), but as shown in FIGS. 7(B) and 8(C), a pivotable scraper 102 is provided between the bottom surface 101*c* and the back surface 101*a* of the plough shaped bit plate 101. The scraper 102 is pivotably supported by a pin 103 fixed to a a scraper plate 104. Further, the reference numeral 105 in FIG. 7(B) is a scraper stopper plate.

When the drill wing bits 100 are rotated clockwise to excavate a pile bore, the scraper 103 pivotes upward as shown by the dot-dot dashed lines in FIG. 7(B) without preventing excavation by the bit teeth 74*a*, 74*b*. However, when the drill wing bits 100 begin to be rotated counterclockwise to raise the bucket body 10, the scraper 103 pivotes downward as shown by the solid lines, being brought into contact with the scraper stopper plate 105, to scrape up excavated soil or muck at the lowermost position of the bucket body within a pile bore now excavated. The scraped soil is moved into the bucket body 10 through the bottom apertures 59 formed in the bucket bottom plate 50.

Figure 7C:
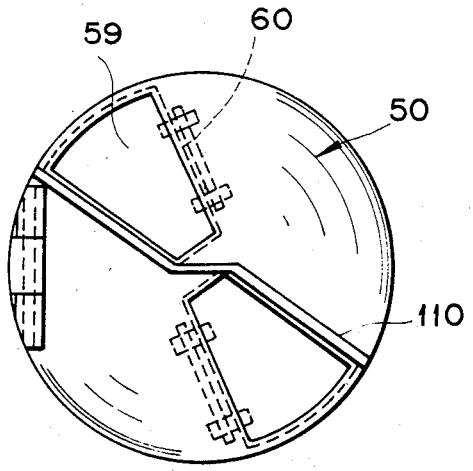
FIG. 7(C) is a bottom view showing a fixed scraper attached to the bucket bottom plate adopted for the second embodiment of the excavating bucket according to the present invention.

In this second embodiment, a fixed scraper 110 is additionally arranged on the outer surface of the bucket bottom plate 50, as shown in FIG. 7(C). The fixed scraper 110 extends radially along the opened edges of the bottom apertures 59. Therefore, the movable scraper 102 scrapes downwards the excavated soil to the center of the bottom plate 50, and the scraped soil is further moved into the bucket body 10 through the bottom apertures 59 by the aid of the fixed scraper 110.

Further, in this second embodiment, as shown in FIG. 8(B), a plurality of circular windows 20 are formed in the cylindrical surface of the bucket body 10 in order to remove water or slurry therethrough. Additionally, a metal net 21 is provided for only a lowest window 20*a*, because there may exist earth and sand near the bottom of the bucket body 10.

The structural features and functional effects of this second embodiment other than those described above are substantially the same as is the case with the first embodiment previously described and any detailed description of them is believed to be unnecessary. The reference numerals have been retained for similar parts which have the same functions.

By the way, the under reaming pile bore excavating bucket according to the present invention is applicable to both dry and wet earth drill method in construction works.

In the wet earth drill method, a pile bore being excavated is filled with water or slurry, that is, the bucket is driven under the water. Therefore, it is impossible to confirm that the slidable wing bits are completely lowered to their lowermost position. In other words, it is impossible to recognize that a desired under reamed part of a pile bore is perfectly excavated. To overcome the above-mentioned drawbacks, conventionally, submersible limit switches or position sensors are used for detecting that the excavator has excavated a pile bore to a desired depth. A signal detected by the switch or sensor is sent to a detection device equipped on the ground to indicate that the excavator should be raised.

In the prior-art submersible switches or sensors for detecting a desired position of an excavator under water, however, since these switches or sensors are operated under water, durability against water and pressure are required for electrical parts used for the switches or sensor and the wires connecting between the switches and the ground detection device, in particular, for the mechanical joint sections.

To overcome the above mentioned shortcomings, in the excavating bucket according to the present invention, a simple mechanical position sensing device using a float is incorporated therewith. In this device, when the excavating bucket has completely excavated the under reamed part of a pile bore, a float is released from the sensing device to the water level, so that the operator can recognize the completion of excavation.

Figure 9:
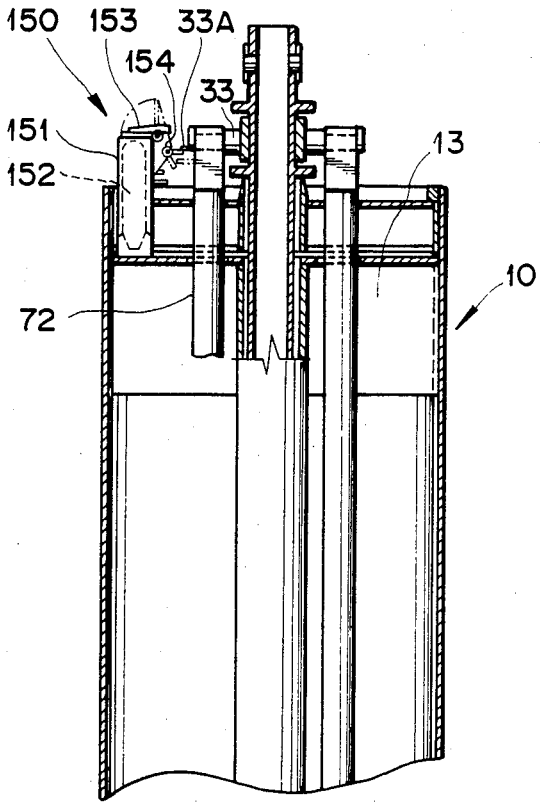
FIG. 9 is a fragmentary longitudinal cross sectional view, partly in side view, of the second embodiment of the excavating bucket according to the present invention, on which a submersible position sensing device according to the present invention is mounted.
Figure 10A:
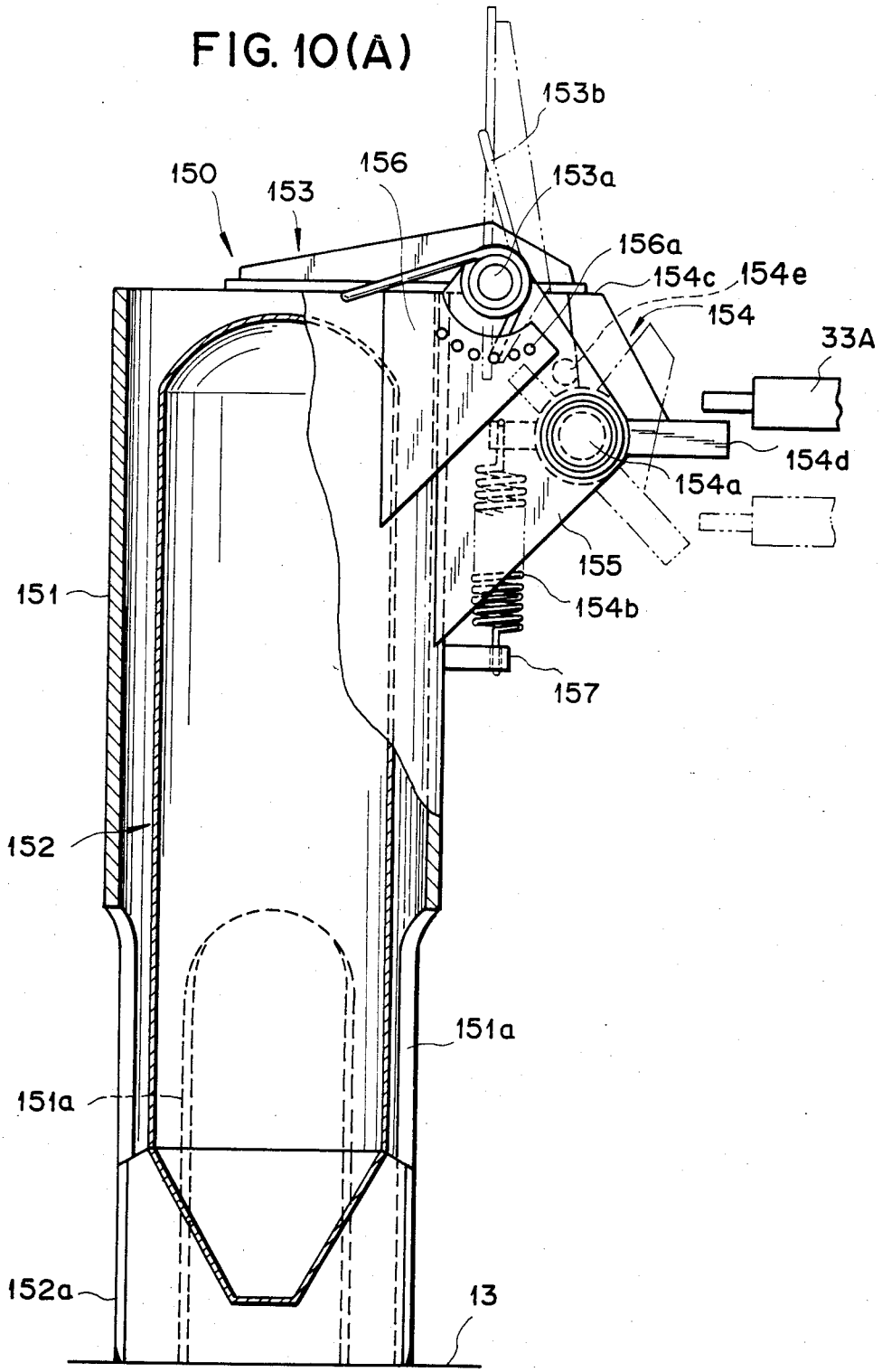
FIG. 10(A) is an enlarged side view, partially in cross section, showing the submersible position sensing device mounted on the second embodiment of the excavating bucket according to the present invention.
Figure 10B:
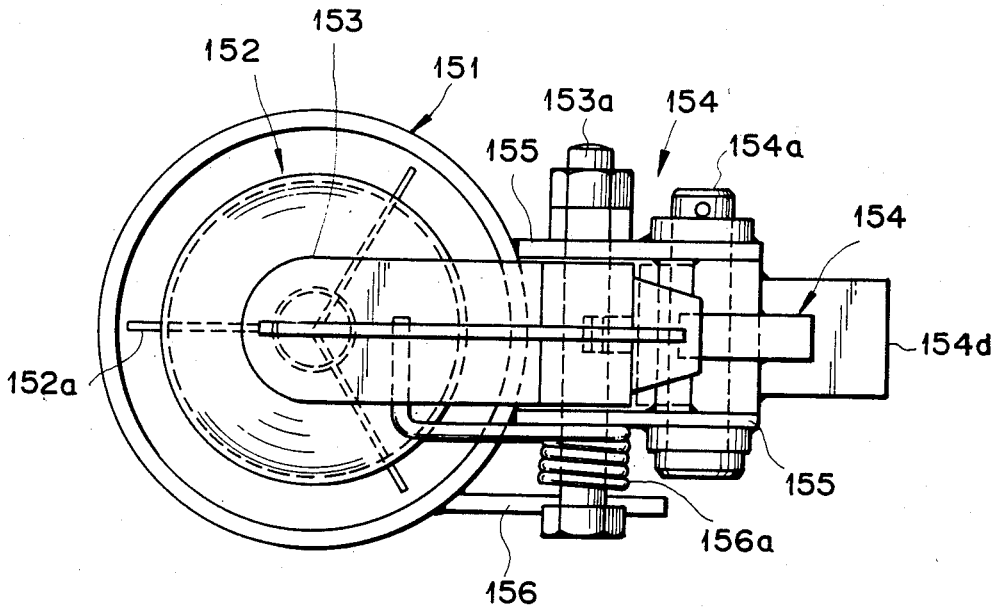
FIG. 10(B) is an enlarged top view of the submersible position sensing device shown in FIG. 10(A).

With reference to FIGS. 9 and 10(A), (B), a float type position sensing device according to the present invention will be described hereinbelow. The position sensing device 150 is attached to the slidable wing drill bit supporting member 13 and actuated by a float release pin 33A implanted in the connecting rod pin 33, as shown in FIG. 9.

The sensing device 150 is roughly made up of a float capsule 151 in which a float 152 is inserted, a float holding plate 153, and a holding plate releasing member 154. The mechanism will be described in further detail with reference to FIG. 10(A).

The float 152 is of cylindrical rocket type, which includes three vertical wings 152*a*. This float 152 is encapsulated within the float capsule 151 on the ground. The float capsule 151 includes three side apertures 151*a* so as to introduce water or slurry thereinto. The float 152 to which an upward floating power is always applied under water or slurry is forcibly stopped by the float holding plate 153. The holding plate 153 is pivotably supported by a first shaft 153*a* supported by two first vertical plates 155 fixed to the outer surface of the float capsule 151 at the uppermost position. This holding platae 153 is urged by a first spring 153*b* clockwise. Further, a second vertical plate 156 is fixed to the outer surface of the float capsule 151 in parallel with the first vertical plates 155. A plurality of spring holes 156*a* are formed in circular arc fashion on the second vertical plate 156, so that an elastaic spring force applied to the holding plate 153 can be adjusted by appropriately selecting a hole to which one end of the first spring 153*b* is fitted. One end of the holding plate 153 extends over the top of the float 152 as shown to depress the float when set.

The holding plate releasing member 154 is also pivotably supported by a second shaft 154*a* supported by the two first vertical plates 155 near the first shaft 153*a*. The holding plate releasing member 154 is urged by a second spring 154*b* counterclockwise. This releasing member 154 includes a locking end portion 154*c* engageable with the other end of the float holding platae 153 and an arm portion 154*d* engageable with the float release pin 33A implanted in the connecting rod pin 33. Further, one end of the second spring 154*b* is hooked to one end portion of the releasing member 154. Further, the other end of the second spring 154*b* is fixed by a spring piece 157 provided at the outer surface of the float capsule 151. The reference numeral 154*e* shown in FIG. 10(A) denotes a stopper pin against the releasing member 154 urged counterclockwise by the second spring 154*b*.

The operation of the position sensing device 150 will be described hereinbelow. When the excavating bucket is on the ground, no floating power is generated. Therefore, the float 152 can readily be inserted into the float capsule 151. After having inserted the float into the capsule 151, the float holding plate 153 is rotated by the operator hand counterclockwise against the first spring 156*a* so that the holding plate 153 holds the top of the capsule 151. In this case, since the releasing member 154 is urged counterclockwise by the second spring 154*b*, the holding plate 153 is automatically locked by the releasing member 154, as shown by the solid lines in FIG. 10(A). In this case, the releasing member 154 is stopped by the stopper pin 154*e*.

Then, the excavating bucket is lowered into a straight pile bore to excavate an under reamed part of the pile bore. If the two wing drill bits 70 slide to the lowermost position, since the float release pin 33A implanted in the connecting rod pin 33 is brought into contact with the releasing member 154 and further rotates the releasing member 154 clockwise against the elastic force of the second spring 154*b*, the holding member 153 is released. Therefore, the holding member 153 rotates clockwise by the elastic force of the first spring 153*b* as shown by the dot-dot dashed lines in FIG. 10(A), so that the float comes to the water surface due to the floating power. By recognizing the float on the water surface, the operator can recognize that the wing drill bitts 70 reach the bottom, so that the excavating bucket is raised on the ground.

In the above description, the position sensing device is so arranged that the float may be released when the two wing drill bits reach at their lowermost position. However, it is also possible to detect the position at which the two wing rill bits reach the middle of the under-reaming stroke. In this case, a relatively deep capsule is used. Further, in order to detect plural strokes of the wing drill bits, it is also possible to provide a plurality of position sensing devices for the excavating bucket.

As described above, in the under reaming pile bore excavating bucket according to the present invention, since the slidable wing drill bits are housed within the bucket body and arranged so as to be moved downward and outward along the guide rails for excavation of an under reamed part of a pile bore, and since the side apertures are formed in the bucket body so as to be opened or closed in synchronization with the sliding movement of the drill bits, it is possible to excavate an under reamed part of a pile bore by the use of a bucket.

Further, since the pivotable scraper is provided under the drill bits so as to be operable when the drill bits are rotated in the reverse direction and since the fixed scraper is further provided on the bucket bottom plate to effectively move the excavated soil into the bucket body through the openable bottom apertures, it is possible to effectively move the excavated soil into the bucket body for removal of soil from the excavated pile bore.

Further, since a mechanical position sensing device of float type is attached to the excavating bucket for detecting the lowermost position of drill bits, it is possible to improve the reliability and the durability of the sensing device.

It will be understood by those skilled in the art that the foregoing description is in terms of a preferred embodiment of the present invention wherein various changes and modifications may be made without departing from the spirit and scope of the invention, as set forth in the appended claims.

What is claimed is:

1. A method of excavating an under reamed part of a pile bore with an excavating bucket having a bucket body with side apertures, an openable bucket bottom plate with openable bottom apertures, a drive shaft, a bucket cover, and wing bits slidably movable by the drive shaft along guide rails downwardly and outwardly when the drive shaft is rotated in a forward direction, which comprises the following steps of:

(a) excavating a straight pile bore;

(b) lowering the excavating bucket to a bottom of the straight pile bore;

(c) closing the bucket bottom plate when the bucket reaches the bottom of the straight pile bore;

(d) rotating the drive shaft in the forward direction to first open the side apertures and then to drive the wing drill bits together with the bucket body in such a way that the rotated wing drill bits move downward and extend outward along the guide rails passing through the opened side apertures to excavate the under reamed part of the pile bore, while taking excavated soil into the bucket body through the side apertures of the bucket body and the openable bottom apertures of the bucket bottom plate;

(e) if the wing drill bits reach their lowermost position, rotating the drive shaft in the reverse direction to move the wing drill bits upward and contract inward along the guide rails passing through the opened side apertures to house again the drill bits within the bucket body while moving excavated soil to under the bucket body and taking the moved soil into the bucket body through the openable bottom apertures;

(f) closing the side apertures by the bucket cover;

(g) raising the excavating bucket onto the round; and (h) opening the openable bucket bottom plate to discharge the excavated soil within the bucket body to the outside.

2. The method of excavating an under reamed part of a pile bore with an excavating bucket as set forth in claim 1, which further comprises the step of releasing a float housed within a float capsule to the surface of water or slurry filled within the pile bore when the slidable wing bits reach their lowermost position.

3. An under reaming pile bore excavating bucket, which comprises:

(a) a bucket body formed with side apertures near a lower part thereof;

(b) a bucket bottom plate attached to a bottom of said bucket body so as to open or close the bottom and formed with openable bottom apertures for taking excavated soil into said bucket body when said bucket body is rotated;

(c) an outer pipe fixed to said bucket body at a center of said bucket body;

(d) a drive shaft telescopically engaged with said outer pipe for rotating said bucket body in one direction through said outer pipe when an excavating torque is applied thereto, said drive shaft sliding downward when rotated in one direction and upward when rotated in the other direction;

(e) a bucket cover engaged with said drive shaft and assembled with said bucket body so as to open the side apertures of said bucket body when rotated in one direction and close the side apertures thereof when rotated in the other direction by said drive shaft;

(f) a plurality of guide rails fixed to said outer pipe at an inclined angle with respect to an axis of said outer pipe;

(g) a plurality of connecting rods, each of one ends of said rods being pivotably connected to said drive shaft, respectively; and (h) a plurality of slidable wing bits pivotably connected to each of the other ends of said connecting rods respectively and slidably mounted on said guide rails at an appropriate bit angle to excavate an under reamed part of a pile bore, whereby when said drive shaft is driven in one direction, the side apertures of said bucket body being first opened and then said wing drill bits are rotated in the same direction together with said bucket body and further moved downward and outward along said guide rails passing through the side apertures now opened by a force of gravity applied thereto to excavate an under reamed part of a pile bore, excavated soil being taken into said bucket body through the opened side apertures of said bucket body and the openable bottom apertures of said bucket bottom plate, when said drive shaft is driven in the other direction, said wing drill bits are moved upward and inward through the opened side apertures along said guide rails by a torque applied to said drive shaft and lastly the side apertures of said bucket body are closed.

4. The under reaming pile bore excavating bucket as set forth in claim 3, wherein said drive shaft and said outer pipe are spline engaged, said drive shaft being formed with plural helical outer tongues and plural helical outer grooves on an outer surface thereof, and said outer pipe being formed with plural helical inner tongues and plural helical inner grooves on an inner surface thereof so as to engage with each other, the spline tongues and grooves being inclined at an appropriate skew angle with respect to the axis of said drive shaft or said outer pipe.

5. The under reaming pile bore excavating bucket as set forth in claim 4, wherein a horizontal stepped cutout portion is formed in the inner tongues of said outer pipe near the upper portion thereof.

6. The under reaming pile bore excavating bucket as set forth in claim 4, wherein an angular width of helical outer tongues of said drive shaft is five-sevenths of that of helical outer grooves of said drive shaft, and an angular width of helical inner tongues of outer pipe is a half of that of helical inner grooves of said outer pipe.

7. The under reaming pile bore excavating bucket as set forth in claim 5, wherein an angular width of the horizontal stepped cutout portion is a half of that of the inner tongues of said outer pipe.

8. The under reaming pile bore excavating bucket as set forth in claim 4, the skew angle of the helical tongues and the helical grooves of said drive shaft and said outer pipe is approximately 14 to 16 degrees with respect to the axis of said drive shaft or said outer pipe.

9. The under reaming pile bore excavating bucket as set forth in claim 4, wherein said bucket cover is formed with a central splined hole engageable with said drive shaft.

10. The under reaming pile bore excavating bucket as set forth in claim 3, wherein said slidable wing bit comprises a plough shaped bit plate having a roughly flat back surface, an arcuate outer side surface and an arcuate bottom surface for allowing excavated soil to be caught thereby and further to be moved into the bucket body through the side apertures of the bucket body, a plurality of bottom bit teeth fixed to the arcuate bottom surface to excavate the bottom of a pile bore, and a plurality of side bit teeth fixed to the arcuate outer side surface to excavate the under reamed part of the pile bore.

11. The under reaming pile bore excavating bucket as set forth in claim 3, wherein said slidable wing bit is provided with a pivotable scraper for scraping excavated soil to under said bucket body when said bucket body is rotated in the other direction without excavating the under reamed part of the pile bore.

12. The under reaming pile bore excavating bucket as set forth in claim 3, wherein said bucket bottom plate is provided with a fixed scraper extending radially of said bottom plate for allowing excavated soil under said bucket body to move into the bucket body through the openable bottom apertures.

13. The under reaming pile bore excavating bucket as set forth in claim 3, wherein said bucket body is formed with a plurality of small side windows in the cylindrical surface of said bucket body for discharging water or slurry from the bucket body to the outside.

14. The under reaming pile bore excavating bucket as set forth in claim 13, wherein a lowest small side window formed near the lower end of the bucket body is covered with a net.

15. The under reaming pile bore excavating bucket as set forth in claim 3, which further comprises a position sensing device for detecting a position in which the two wing drill bits reach at their lowermost position.

16. The under reaming pile bore excavating bucket as set forth in claim 15, wherein said position sensing device comprises:

(a) a float capsule attached to a top of said bucket body;

(b) a float inserted into said float capsule;

(c) a float holding member disposed so as to cover a top opening of said float capsule to hold said float within said float capsule under water when urged by the hand against an elastic force of a first spring attached thereto;

(d) a float releasing member engaged with said float holding member to hold said holding member at a position where said float is housed within said float capsule when urged by an elastic force of a second spring attached thereto;

(e) a releasing pin attached to said drive shaft for actuating said float releasing member against the elastic force of the second spring in a direction that said float holding member is urged by the elastic force of the first spring to allow said float to come to the surface of water when said wing drill bits reach their lowermost position.

* * * * *